US006546609B1

(12) United States Patent
Lee et al.

(10) Patent No.: US 6,546,609 B1
(45) Date of Patent: Apr. 15, 2003

(54) AUTOMATIC RIVETING APPARATUS

(75) Inventors: Sheng Ching Lee, Tu-Chen (TW); YaQiang He, Shenzhen (CN); ZhaoLai Meng, Shenzheng (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/104,810

(22) Filed: Mar. 21, 2002

(30) Foreign Application Priority Data

Dec. 12, 2001 (TW) ..... 90130742 A

(51) Int. Cl.[7] ..... B23P 11/00

(52) U.S. Cl. ..... 29/243.53; 29/251; 29/243.5; 269/60

(58) Field of Search ..... 29/243.53, 243.5, 29/243.54, 705, 251; 269/60

(56) References Cited

U.S. PATENT DOCUMENTS 5,249,902 A * 10/1993 Stankiewicz ..... 29/243.53
5,291,644 A * 3/1994 Musil ..... 29/243.53
5,329,691 A * 7/1994 Roberts et al. ..... 29/705
5,778,505 A * 7/1998 Mangus et al. ..... 29/243.53
6,408,526 B1 * 6/2002 Montesanti et al. ..... 269/60

* cited by examiner

*Primary Examiner*—Lee Wilson
(74) *Attorney, Agent, or Firm*—Wei Te Chung

(57) ABSTRACT

An automatic riveting apparatus includes a base (10), a feeding device (30), and a riveting device (50). The base has a U-shaped support frame (12). Two photoelectric relays (18) extend upwardly from the base. The feeding device includes two parallel sliding rails (32), a lower die plate (36) for supporting a workpiece (80), and a feed cylinder (34) driving the lower die plate to slide along the rails. The riveting device has an upper cylinder (52) and a riveting head (58). In operation, the feed cylinder is started up to drive the lower die plate together with the workpiece to a riveting position. The lower die plate touches a photoelectric point (48) to actuate the upper cylinder. A piston rod (60) of the upper cylinder drives the riveting head downwardly to rivet the workpiece. The piston rod moves back up, and the lower die plate returns to its original position.

12 Claims, 3 Drawing Sheets

AUTOMATIC RIVETING APPARATUS

BACKGROUND OF THE INVENTION

1. Field of the Invention

The present invention relates to a riveting apparatus, and in particular to a riveting apparatus having automatic feeding and automatic withdrawal of a workpiece.

2. Related Art

In numerous fields of manufacturing, riveting is widely used to combine parts. Most contemporary riveting processes are merely semi-automatic. That is, a workpiece is placed on a riveting apparatus. The workpiece is manually pushed to a riveting position. After completion of riveting, the workpiece is manually withdrawn from the apparatus. This process is not only unduly slow, but also prone to cause accidental injury to an operator's hands and arms.

In order to increase productivity, fully automatic riveting apparatuses have been developed. Such apparatuses can perform feeding and withdrawal automatically. However, such apparatuses typically have a complicated structure and occupy a large space. Moreover, the apparatus is relatively expensive and consumes much energy, thereby inflating production costs.

Thus, a riveting apparatus which overcomes the above-mentioned problems is desired.

BRIEF SUMMARY OF THE INVENTION

Accordingly, an object of the present invention is to provide a riveting apparatus which can complete automatic feeding and automatic withdrawal readily and securely.

Another object of the present invention is to provide a riveting apparatus which has a simple structure.

A further object of the present invention is to provide a riveting apparatus which prevents operators from being accidentally injured.

To achieve the above-mentioned objects, an automatic riveting apparatus comprises a base, a feeding device and a riveting device. The base has a U-shaped support frame. A pair of photoelectric relays extends upwardly from the base. The feeding device comprises two parallel sliding rails, a lower die plate for supporting a workpiece, and a feed cylinder driving the lower die plate to slide along the rails. The riveting device has an upper cylinder and a riveting head. In operation, the feed cylinder is started up to drive the lower die plate together with the workpiece to a riveting position. The lower die plate touches a photoelectric contact point to actuate the upper cylinder. A piston rod of the upper cylinder drives the riveting head downwardly to rivet the workpiece. Then, the piston rod moves back up, and the lower die plate returns to its original position.

Other objects, advantages and novel features of the present invention will be drawn from the following detailed description of a preferred embodiment of the present invention with the attached drawings, in which:

DESCRIPTION OF THE PREFERRED EMBODIMENTS

Figure 1:
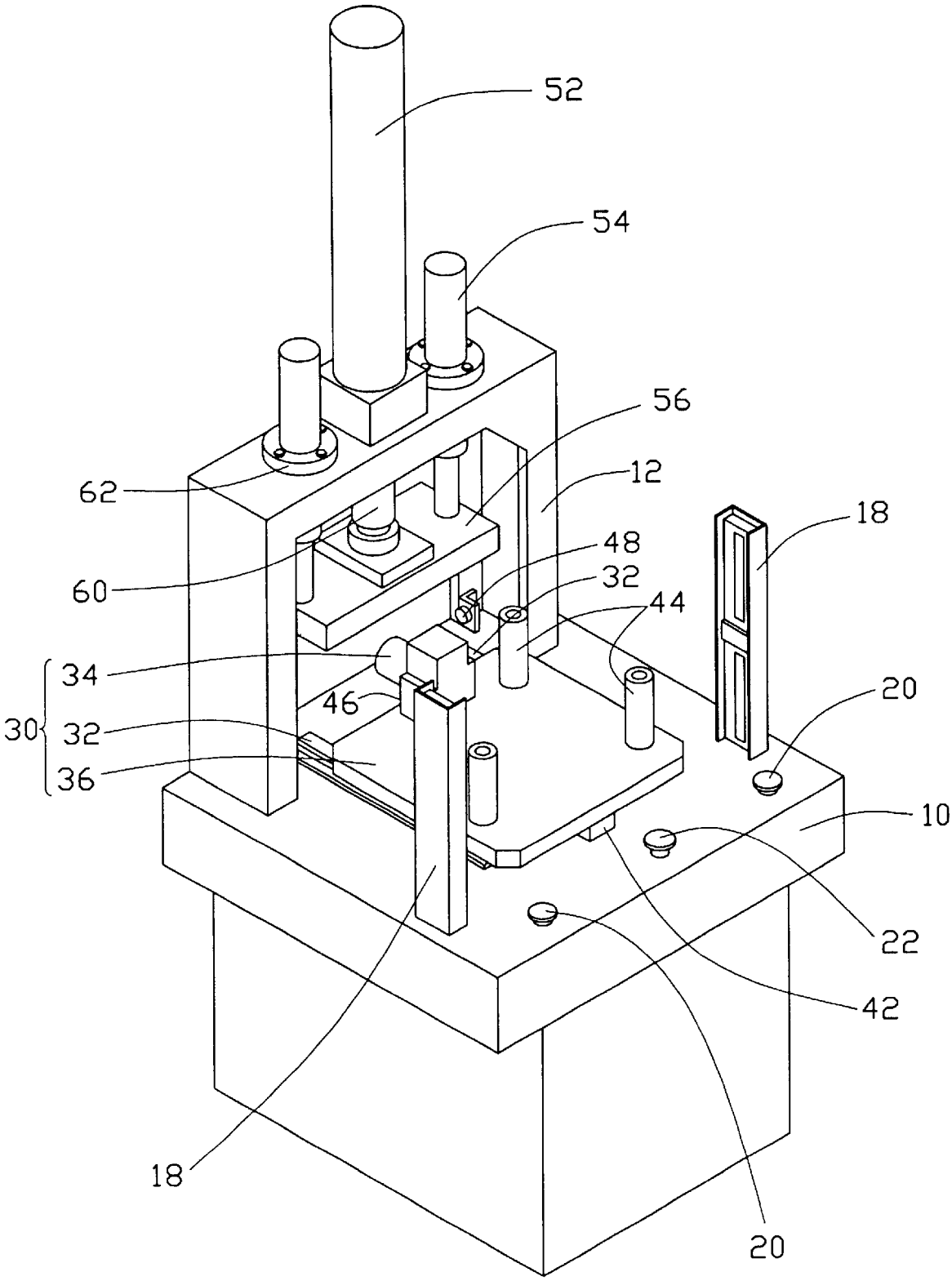
FIG. 1 is a perspective view of a riveting apparatus in accordance with the present invention.
Figure 2:
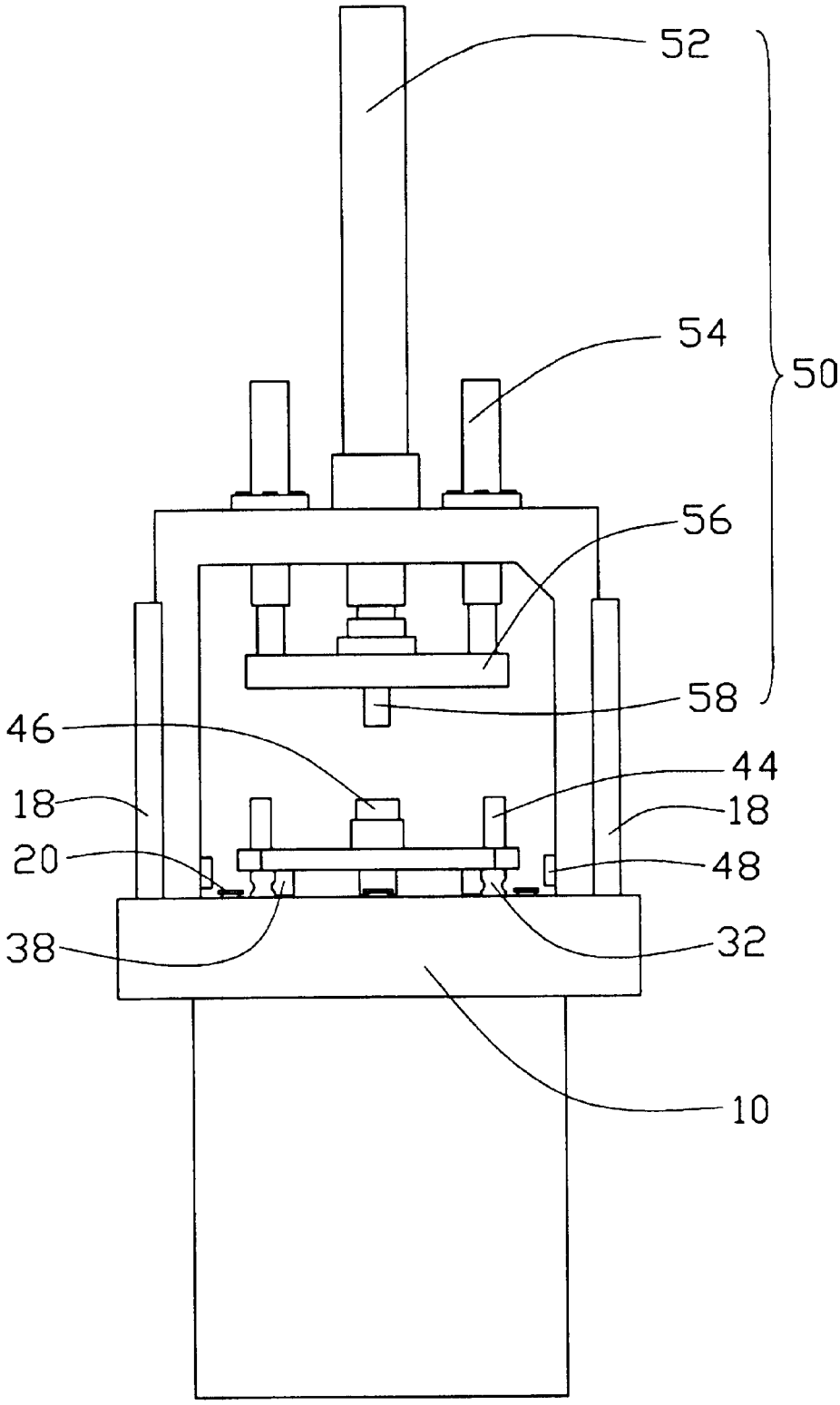
FIG. 2 is front elevational view of FIG. 1.

Referring to FIGS. 1 and 2, an automatic riveting apparatus of the present invention includes a base 10, a feeding device 30 and a riveting device 50.

A U-shaped support frame 12 extends upwardly from a rear portion of a top surface of the base 10. A pair of opposing photoelectric relays 18 extends upwardly from opposite sides of a front portion of the top surface of the base 10. When an object is between the two photoelectric relays 18, the riveting apparatus cannot be started up. That is, when an operator is placing a workpiece 80 (see FIG. 3) on the riveting apparatus, the operator's safety is ensured. A pair of start-up buttons 20 is disposed on opposite sides respectively of a front portion of the base 10. An emergency button 22 is disposed on the front portion of the base 10 between the start-up buttons 20.

The feeding device 30 includes two parallel sliding rails 32, a feed cylinder 34 and a lower die plate 36. The sliding rails 32 are mounted on a middle of the top surface of the base 10 and extend beneath the support frame 12. The feed cylinder 34 is positioned between the sliding rails 32. A direction of movement of a piston shaft (not shown) of the feed cylinder 34 is parallel to the sliding rails 32. A pair of sliding blocks 38 depends from respective opposite sides of a bottom surface of the lower die plate 36. An outer longitudinal face of each sliding block 38 has a shape complementary with a shape of an inner longitudinal face of a corresponding abutting sliding rail 32. Thus the sliding blocks 38 can slide along the sliding rails 32. A connecting block 42 is formed on a middle portion of the bottom surface of the lower die plate 36. The connecting block 42 is connected with one end of the piston shaft and the lower die plate 36. Thus when the piston shaft of the feed cylinder 34 moves, the lower die plate 36 moves accordingly. A support pole 44 extends upwardly from each of at least three comers of the lower die plate 36, for supporting the workpiece 80 (see FIG. 3). A rivet die 46 extends upwardly from a top surface of the lower die plate 36, for supporting a portion of the workpiece 80 requiring riveting. A height of the rivet die 46 is the same as a height of the support poles 44. A pair of photoelectric contact points 48 is respectively attached to opposite inner side walls of the frame 12.

The riveting device 50 includes an upper cylinder 52, two guide poles 54, a connecting plate 56, and a riveting head 58. The upper cylinder 52 vertically extends through a middle of an upper beam of the support frame 12. The connecting plate 56 is connected with a bottom end of a piston rod 60 of the upper cylinder 52. Two vertical through holes (not shown) are defined through the upper beam of the support frame 12 at respective opposite sides of the upper cylinder 52. A guide sleeve 62 is fixed in each through hole. The guide poles 54 respectively extend through the guides sleeve 62. A bottom end of each guide pole 54 is connected with the connecting plate 56. The riveting head 58 is mounted to a middle of a bottom surface of the connecting plate 56, and corresponds to the rivet die 46 of the lower die plate 36.

Figure 3:
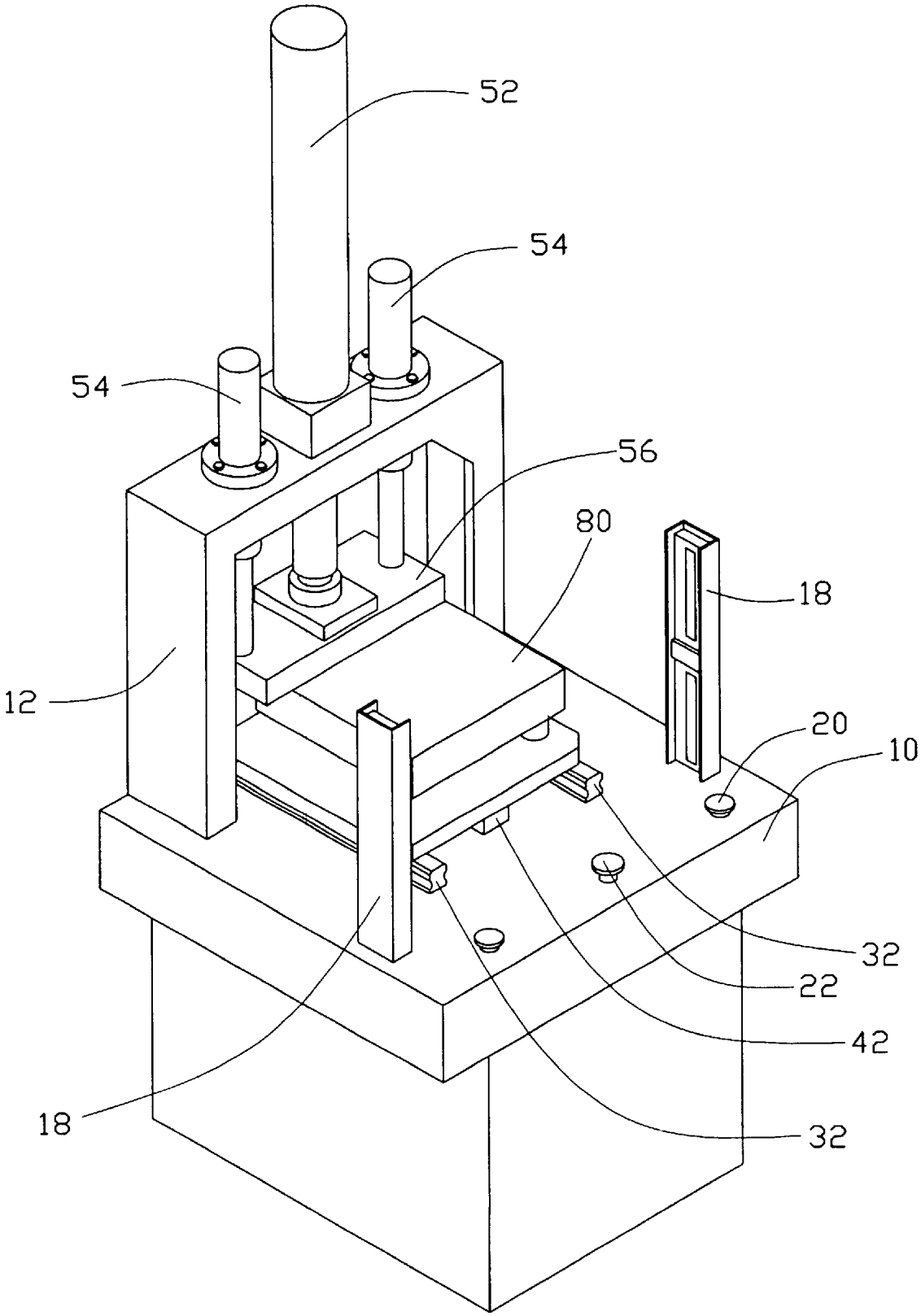
FIG. 3 is similar to FIG. 1, but showing the riveting apparatus operating on a workpiece.

Referring also to FIG. 3, in operation, the workpiece 80 is placed on the support poles 44 of the lower die plate 36, and the portion of the workpiece 80 requiring riveting is positioned on the rivet die 46 of the lower die plate 36. The operator presses the start-up buttons 20 at the same time with both hands. The piston shaft of the feed cylinder 34 drives the lower die plate 36 and the workpiece 80 to reach a predetermined riveting position. At the same time, the lower die plate 36 touches the photoelectric contact points 48 to actuate the riveting device 50. The piston rod 60 moves downwardly and drives the riveting head 58 to rivet the workpiece 80. The piston rod 60 together with the riveting head 58 moves back up away from the workpiece 80 after the riveting operation is completed. The piston shaft of the fe ed cylinder 34 drives the lower die plate 36 and the workpiece 80 to return to their original positions. The operator can thereupon readily and safely take the workpiece 80 off the lower die plate 36.

It is understood that the invention may be embodied in other forms without departing from the spirit thereof. Thus, the present example and embodiment are to be considered in all respects as illustrative and not restrictive, and the invention is not to be limited to the details given herein.

What is claimed is:

1. An automatic riveting apparatus, comprising:

a base having a support frame extending upwardly from a rear portion of the base, at least one contact point disposed on the support frame, and two photoelectric relays extending upwardly from opposite sides of a front portion of the base;

a feeding device disposed on the base, the feeding device comprising two parallel sliding rails, a lower die plate, and a feed cylinder driving the lower die plate to slide along the sliding rails, a rivet die being disposed on the lower die plate for positioning of a workpiece thereon; and a riveting device for riveting the workpiece, the riveting device having an upper cylinder and a riveting head connected under the upper cylinder and corresponding to the rivet die of the lower die plate, the upper cylinder vertically extending through the support frame of the base;

wherein when the lower die plate is automatically driven to an operation position by pushing a button in front of the photoelectric relays, the lower die plate touches the at least one contact point of the base, so that the riveting device is actuated to rivet the workpiece.

2. The automatic riveting apparatus as described in claim 1, wherein the sliding rails are disposed on a middle of an upper surface of the base, and the feed cylinder is disposed on the upper surface of the base between the sliding rails.

3. The automatic riveting apparatus as described in claim 1, wherein two sliding blocks depend from opposite sides of a bottom surface of the lower die plate, and a face of each of the sliding blocks has a shape complementary with a shape of a face of a corresponding abutting sliding rail, whereby the sliding blocks can slide along the sliding rails.

4. The automatic riveting apparatus as described in claim 1, wherein the support frame is generally U-shaped, and two photoelectric contact points are disposed on opposite inner side walls of the support frame.

5. The automatic riveting apparatus as described in claim 1, wherein at least one vertical through hole is defined through the support frame at least one of opposite sides of the upper cylinder, and a guide sleeve is disposed in each of the through holes.

6. The automatic riveting apparatus as described in claim 5, wherein the riveting device further comprises at least one guide pole extending through the at least one guide sleeve, a lower end of the at least one guide pole is connected with a connecting plate, the connecting plate is connected with a lower end of a piston rod of the upper cylinder, and the riveting head is mounted to a bottom surface of the connecting plate.

7. The automatic riveting apparatus as described in claim 1, wherein when an object is between the relays the riveting apparatus cannot be started up, thereby ensuring safety for an operator.

8. The automatic riveting apparatus as described in claim 1, wherein a plurality of support poles is disposed on the lower die plate for supporting the workpiece.

9. The automatic riveting apparatus as described in claim 1, wherein a pair of start-up buttons is disposed on opposite sides of a front portion of the base, and an emergency button is disposed on the front portion of the base between the start-up buttons.

10. An automatic riveting apparatus comprising:

a base having a support frame and a photoelectric contact point positioned thereon;

a feeding device disposed on the support frame, said feeding device including a lower die, with a rivet die thereon, horizontally moveable along a first direction and contacting the contact point of the base at an operation position for actuating a riveting device, said riveting device including a riveting head aligned with the rivet dies when said rivet die is positioned at the operation position, said riveting head is actuated to move downwardly in a second direction perpendicular to said first direction; wherein movement of the lower die along the first direction and movement of the riveting head in the second direction are through cylinders.

11. A method of riveting a workpiece, comprising the steps of:

providing a base with a supporting frame and a photoelectric contact point thereon;

providing a feeding device with a lower die plate having a rivet die thereon;

disposing a workpiece on the rivet die;

pushing a button to horizontally move the lower die plate with the workpiece in a first direction by cylinder pressure until touching the contact point of the base;

actuating a riveting device, by touch of the contact point, to move downwardly in a second direction wherein said riveting device includes a riveting head;

moving said riveting head toward the rivet die which is vertically aligned and located under the riveting head and rivet with the workpiece therebetween by cylinder pressure so as to rivet the workpiece accordingly;

successively and individually moving, by cylinder pressure, the riveting head and the lower die plate in directions opposite to the second direction and the first direction, respectively; and removing the riveted workpiece from the lower die plate.

12. The method of riveting a workpiece as described in claim 11, further comprising a step of providing two photoelectric relays at a front of the base behind the button, wherein when an object is between the relays, the feeding device and the riveting device cannot be started up, thereby ensuring safety for an operator.

* * * * *